United States Patent [19]

Schorr et al.

[11] Patent Number: 4,745,768

[45] Date of Patent: May 24, 1988

[54] COMBUSTION-POWERED REFRIGERATION WITH DECREASED FUEL CONSUMPTION

[75] Inventors: Hans P. Schorr, Douglaston; Daniel J. Dessanti, Brooklyn, both of N.Y.

[73] Assignee: The Brooklyn Union Gas Company, Brooklyn, N.Y.

[21] Appl. No.: 90,127

[22] Filed: Aug. 27, 1987

[51] Int. Cl.[4] ..... F25B 27/00

[52] U.S. Cl. ..... 62/238.6; 62/238.3; 62/332; 62/335; 62/476

[58] Field of Search ..... 62/79, 101, 148, 238.3, 62/238.6, 332, 335, 476

[56] References Cited

U.S. PATENT DOCUMENTS

| | | | |
|---|---|---|---|
| 3,015,940 | 1/1962 | Harwich | 62/335 X |
| 3,483,710 | 12/1969 | Bearint | 62/79 |
| 3,824,804 | 7/1974 | Sandmark | 62/335 X |
| 4,199,961 | 4/1980 | Carter et al. | 62/335 X |
| 4,373,346 | 2/1983 | Hebert et al. | 62/79 |
| 4,471,630 | 9/1984 | Sugimoto et al. | 62/335 X |
| 4,586,344 | 5/1986 | Lutz et al. | 62/335 X |

*Primary Examiner*—Lloyd L. King
*Attorney, Agent, or Firm*—Paul W. Garbo

[57] ABSTRACT

In refrigeration systems wherein the refrigerant compressor is driven by a prime mover powered by combustion of a fluid fuel, a notable saving in fuel consumption is achieved by utilizing waste heat in the hot exhaust gases from the prime mover in an absorption refrigeration unit that chills a coolant stream circulated to the condenser for the compressed refrigerant. Existing combustion-powered refrigeration systems can be improved by adding a lithium halide absorption unit to utilize heat in the exhaust gases to produce refrigeration that is used to condense the compressed refrigerant. A combustion turbine coupled to a centrifugal compressor is a preferred combination of prime mover and refrigerant compressor for economically producing tonnage refrigeration.

16 Claims, 1 Drawing Sheet

COMBUSTION-POWERED REFRIGERATION WITH DECREASED FUEL CONSUMPTION

BACKGROUND OF THE INVENTION

This invention relates to improved refrigeration from systems wherein the refrigerant compressor is driven by power generated by combustion of a fluid fuel, i.e., gas or liquid, such as natural gas or diesel oil, to propel an engine or turbine. More particularly, the invention utilizes the hot exhaust gases of such a combustion-powered prime mover to reduce the energy consumption of refrigeration production.

The basic refrigeration system is a closed cycle or loop generally involving a compressor, a cooler, a condenser and an evaporator. Frequently, the refrigeration system includes a subcooler between the condenser and the evaporator. The compressor is often driven by an electric motor but for the production of tonnage refrigeration, where a fluid fuel is cheaper than electricity, the compressor is generally driven by an internal combustion engine or a combustion turbine.

A principal object of this invention is to enhance the saving in energy cost of refrigeration systems wherein an engine or turbine drives the refrigerant compressor.

A further object is to utilize the waste heat in the exhaust gases of the engine or turbine to achieve an appreciable decrease of fuel consumption in refrigeration production.

Another important object is to provide the well known absorption refrigeration system to convert the waste heat of the exhaust gases of combustion-powered prime mover into refrigeration which is applied to the compressed main refrigerant to effect its condensation.

These and other objects and advantages of the invention will be apparent from the description which follows.

SUMMARY OF THE INVENTION

In accordance with this invention, a refrigeration system wherein the refrigerant compressor is driven by a combustion engine or turbine has an absorption refrigeration system connected for the flow of hot exhaust gases from the engine or turbine through the heating tubes in the concentrator of the absorption refrigeration system and further connected to circulate a coolant stream from the absorption unit to the condenser for the compressed main refrigerant, and back to the absorption unit. Some absorption refrigeration units available in commerce operate only with steam heat; in such cases, the hot exhaust gases are used to generate steam which is then passed through the heating tubes in the concentrator of the absorption system. Hence, the hot exhaust gases of the prime mover are advantageously used directly or indirectly to generate refrigeration in the absorption unit.

As known in the mechanical art, there are available several combinations of combustion-powered prime movers and compressors. An internal combustion engine may drive a reciprocating compressor or a screw compressor. A combustion turbine may drive a screw compressor or a centrifugal compressor. Ideally, a turbine is directly coupled to a centrifugal compressor.

The absorption refrigeration system used pursuant to this invention is offered today as a standard unit by several prominent companies, such as Trane, Hitachi and Carrier. These commercial absorption systems commonly are aqueous solutions of a lithium halide, preferably lithium bromide, usually admixed with other metal halides, such as zinc bromide, as the working fluids therein.

BRIEF DESCRIPTION OF THE DRAWINGS

For a fuller understanding of the invention, the ensuing description will refer to the appended drawings of which.

DESCRIPTION OF PREFERRED EMBODIMENTS

Figure 1:
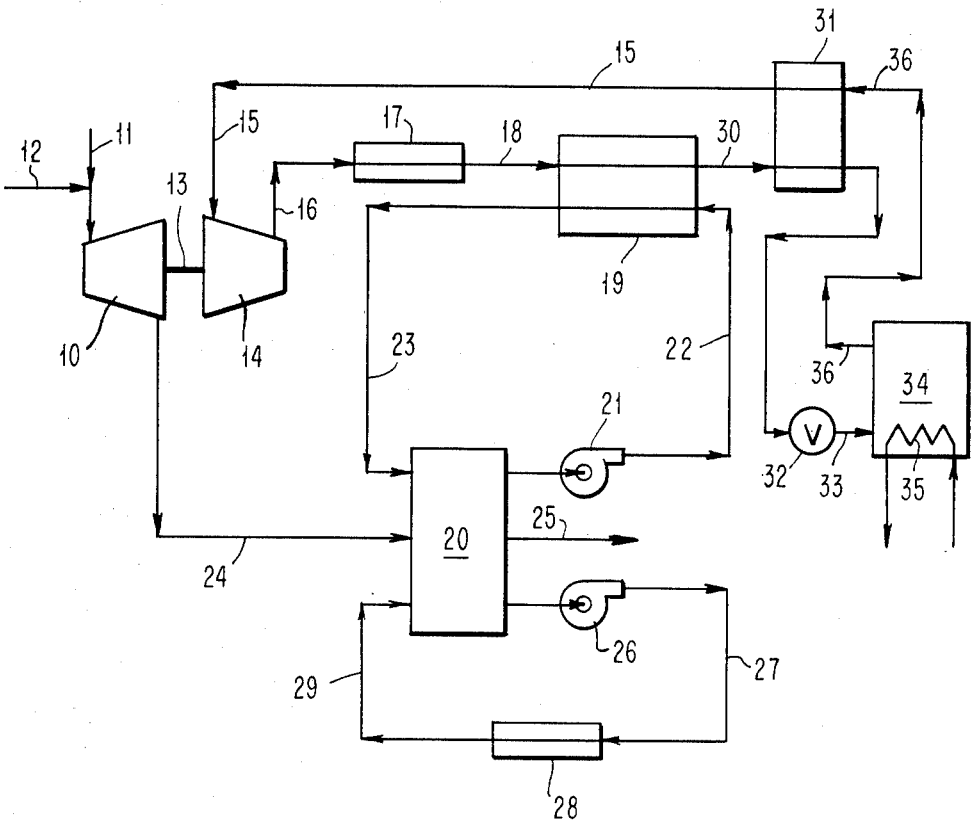
FIG. 1 is a flow diagram of a preferred embodiment of this invention.

The description of FIG. 1 will include data of specific examples of the invention.

Natural gas with a low (net) heating value of 965 British Thermal Units per standard cubic foot enters the combustor of gas turbine 10 via line 11 with the required amount of combustion air from line 12. The rate of natural gas consumption is 40,400 standard cubic feet per hour (SCFH). The power generated by turbine 10 is transferred through singleshaft coupling 13 to centrifugal compressor 14 which increases the pressure of Freon R-12 (DuPont) refrigerant vapor entering via line 15 at 13.3 psia* and temperature of 67° F. and exiting via line 16 at 99 psia and about 275° F. Freon R-12 has a molecular weight of 121 and is circulated by compressor 14 at the rate of 3204 pound mols per hour (PMH). The warm compressed refrigerant passes through cooler 17 which in this example is cooled by ambient air at 80° F. The cooled refrigerant at 97 psia and 100° F. flows from cooler 17 through line 18 to condenser 19 from which it discharges at 95 psia and 77° F. This cooling of the compressed refrigerant causes condensation of the refrigerant and is accomplished by circulating chilled water at 62° F. from absorption refrigeration unit 20 with pump 21 through line 22 to condensing exchanger 19 from which the water at 72° F. returns via line 23 to absorption unit 20. The rate of chilled water circulation is 5100 gallons per minute (GPM).

*psia (pounds per square inch absolute)

The hot exhaust gases leave turbine 10 through line 24 at 15.2 psia and approximately 990° F. and pass through absorption refrigeration system 20 sold by Hitachi. The waste heat of the exhaust gases is utilized in the concentrator of system 20 to vaporize water from the lithium bromide solution circulated therethrough. The exhaust gases are vented at about 350° F. from unit 20 to the atmosphere via line 25. As known, absorption unit 20 requires the passage of cooling water therethrough. For this purpose, unit 20 is provided with a cooling water loop in which pump 26 draws warm water at about 115° F. from unit 20 and circulates it through line 27, cooler 28 and line 29 back to unit 20. In this example, cooler 28 is an air cooler which lowers the temperature of the cooling water to about 100° F.

The condensed refrigerant leaving heat exchanger 19 at 95 psia and 77° F. flows through line 30 to subcooler exchanger 31 from which the refrigerant issues at 94 psia and 21° F. and then passes through pressure reducing valve 32 in line 33. The expanded refrigerant discharges from line 33 at 15.3 psia and −20° F. into evaporator 34 which is provided with refrigeration recovery coil 35. Antifreeze or other suitable fluid with a freezing point lower than −20° F. is passed through coil 35 to convey the recovered refrigeration to one or more operations requiring refrigeration, such as the commercial freezing of fish and meat. The antifreeze passing through coil 35 conveys 2000 tons of refrigeration at −20° F. to refrigeration consumers.

Refrigerant vapor at 15.3 psia and −20° F. passes from evaporator 34 through line 36 and exchanger 31 wherein the vapor subcools the compressed refrigerant and therefore is warmed to 67° F. The warm refrigerant vapor at 13.3 psia flows from exchanger 31 through line 15 back to centrifugal compressor 14 to complete the circulation of Freon R-12 refrigerant through the main refrigeration loop.

By utilizing the heat in the exhaust gases from turbine 10 in absorption refrigeration system 20 to provide the chilled water passed through exchanger 19 to condense the compressed refrigerant, the energy consumption of the entire refrigeration system is approximately 17% less than what it would be in the absence of absorption refrigeration unit 20. This considerable power saving seems all the more noteworthy because the chilled water supplied by absorption unit 20 to condensing exchanger 19 was warmed only 10° F. but reduced the temperature of the compressed refrigerant from 100° F. to 77° F. and thus effected its condensation.

In another example of the invention designed to deliver 2000 tons of refrigeration at −20° F., cooler 17 is cooled with water from a cooling tower and cooler 28 associated with absorption system 20 is a water cooling tower. In this case, Freon R-12 refrigerant vapor enters centrifugal compressor 14 at 13.3 psia and 57° F. at the rate of 3169 PMH and issues at 86 psia and about 245° F. The hot compressed refrigerant is cooled by passage through cooler 17 through which water from a cooling tower is circulated to drop the temperature of the compressed refrigerant to 100° F. The compressed refrigerant at 84 psia passes via line 18 through condensor 19 and the condensed refrigerant at 81 psia and 67° F. flows through line 30 and subcooler 31 exiting at 80 psia and 18° F. The subcooled refrigerant is expanded by passage through pressure reducing valve 32 and at 15.3 psia and −20° F. discharges from line 33 into evaporator 34. Antifreeze flowing through coil 35 transfers refrigeration from avaporator 34 to one or more purchasers of tonnage refrigeration.

Refrigerant vapor leaving evaporator 34 through line 36 is warmed in subcooler 31 to 57° F. and thence conveyed by line 15 back to compressor 14.

As in the first example, the natural gas is supplied by line 11 to the combustor of turbine 10 together with the required amount of combustion air from line 12. The consumption of natural gas is 36,300 SCFH. Hot exhaust gases at 15.2 psia and about 940° F. pass from turbine 10 through line 24 and the concentrator of Hitachi lithium bromide absorption unit 20 from which the exhaust gases at about 350° F. are vented to the atmosphere via line 25. Heat removed from the exhaust gases flowing through unit 20 chills water to 52° F.; the chilled water is circulated by pump 21 at the rate of 5060 GPM through line 22 and condenser 19 and returned at 62° F. by line 23 to unit 20. Cooling water for unit 20 is circulated from unit 20 at about 100° F. by pump 26 and line 27 to cooling tower 28 and returned therefrom at 85° F. via line 29 to unit 20.

As in the first example, the utilization of hot exhaust gases from turbine 10 in absorption refrigeration system 20 to provide chilled water circulated by pump 21 through condenser 19 reduces the energy consumption of the entire refrigeration system by about 26% when compared with the same refrigeration system lacking absorption unit 20.

Figure 2:
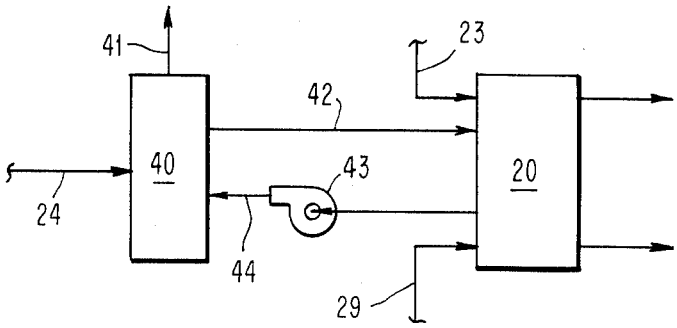
FIG. 2 is a variation of part of the flow diagram of FIG. 1.

As previously mentioned, some absorption refrigeration systems, such as those sold by Trane, operate only with steam heat. FIG. 2 shows diagrammatically how the flow diagram of FIG. 1 is modified when absorption unit 20 requires heating with steam. In such case, the hot exhaust gases from turbine 10 flow through line 24 into steam generator 40 wherein waste heat in the exhaust gases produces steam. The resulting cooled exhaust gases are vented to the atmosphere through line 41. Steam flows from generator 40 via line 42 to the concentrator of absorption system 20. Condensed steam is recycled from system 20 by pump 43 and line 44 back to steam generator 40. In all other respects, the flow diagram of FIG. 1 remains unchanged.

While the foregoing examples are based on the use of Freon R-12, other fluorocarbons such as DuPont's R-13 or R-22 may be selected as the refrigerant. Other practical refrigerants include ammonia, propane and propylene. The temperature level at which refrigeration is delivered by this invention can be varied over the commercially important range of about 35° F. down to −50° F. As known in the refrigeration art, the desired refrigeration temperature level is attained by selecting an appropriate refrigerant and controlling the pressures of the refrigerant on entering the condenser and on leaving the evaporator.

The fuel saving achieved by this invention is significant for refrigeration systems delivering at least about 50 tons of refrigeration; for such low refrigeration tonnage, an internal combustion engine is currently the only practical prime mover for the refrigerant compressor, the reciprocating or screw type. Better fuel savings are attained in system delivering at least 200 tons of refrigeration because in such larger systems it is feasible to use the efficient combination of a combustion turbine coupled to a screw compressor or centrifugal compressor. The benefits of this invention are applicable to exisitng refrigeration systems wherein the compressor is driven by a combustion-powered prime mover. The retrofit of such existing systems is economically attractive particularly for those producing 200 to 500 tons of refrigeration, and simply involves the purchase and installation of an absorption refrigeration unit to utilize waste heat from the hot exhaust gases of the prime mover and to circulate a chilled coolant from the unit to the condensor of the compressed refrigerant. The fuel economy obtained by this invention makes the building and operation of new refrigeration systems with capacities of 1000 to 5000 tons of refrigeration particularly profitable.

Variations and modifications of the invention will be apparent to those skilled in the art without departing from the spirit and scope of the invention. For example, subcooler 31, which is an optional component of the refrigeration cycle or loop, may be eliminated without materially diminishing the energy saving of the refrigeration system shown in FIG. 1. Also, it is not necessary to use the same cooling medium, i.e., air or water, in cooler 17 and cooler 28; thus, cooler 17 may use air while cooler 28 uses water. Accordingly, only such limitations should be imposed on the invention as are set forth in the appended claims.

What is claimed is:

1. An improved refrigeration system comprising a refrigerant vapor compressor driven by a prime mover powered by the combustion of a fluid fuel, a cooler connected to said compressor to remove heat from the hot compressed refrigerant vapor, a condenser connected to said cooler to condense the cooled compressed refrigerant vapor, a pressure reducing valve connected for the expansion of the condensed refrigerant and for the discharge of the expanded refrigerant into an evaporator equipped with heat transfer surface for the recovery of refrigeration from said evaporator by a fluid passed in contact with said heat transfer surface, said evaporator connected to pass refrigerant vapor therefrom back to said compressor, and an absorption refrigeration unit with an aqueous solution comprising lithium halide as absorbent connected to utilize waste heat of the hot exhaust gases from said prime mover and further connected to circulate a coolant chilled by said absorption unit through said condenser and back to said absorption unit.

2. The refrigeration system of claim 1 wherein a subcooler exchanger is connected to the condenser for the flow of condensed refrigerant therethrough prior to expansion in the pressure reducing valve, and is further connected to the evaporator for the flow of refrigerant vapor therefrom in countercurrent heat exchange relation with said condensed refrigerant in said subcooler exchanger before said refrigerant vapor passes back to the compressor.

3. The refrigeration system of claim 1 wherein the compressor is a screw compressor or centrifugal compressor and the combustion-powered prime mover is a combustion turbine.

4. The refrigeration system of claim 1 wherein the compressor is a reciprocating compressor screw compressor and the combustion-powered prime mover is an internal combustion engine.

5. The refrigeration system of claim 1 wherein the refrigerant is selected from the group consisting of fluorocarbons, ammonia, propane and propylene.

6. The refrigeration system of claim 1 wherein the cooler is cooled by air.

7. The refrigeration system of claim 1 wherein the cooler is cooled by water circulated to a water cooling tower.

8. The refrigeration system of claim 2 wherein the compressor is a centrifugal compressor, the combustion-powered prime mover is a combustion turbine coupled to said centrifugal compressor, and the refrigerant is of the fluorocarbon type.

9. The refrigeration system of claim 2 wherein the compressor is a screw compressor, the combustion-powered prime mover is a diesel engine and the refrigerant is of the fluorocarbon type.

10. The improved refrigeration process which comprises combusting a fluid fuel for the performance of work by a prime mover, utilizing said performance of work to compress refrigerant vapor, cooling the compressed refrigerant vapor, condensing the cooled compressed refrigerant vapor by heat exxhange with a coolant as herebelow specified, isenthalpically expanding the condensed refrigerant, discharging the expanded refrigerant into an evaporation zone, recovering refrigeration from said evaporation zone, returning refrigerant vapor from said evaporation zone to the aforesaid compression thereof, utilizing waste heat in the hot combustion gases leaving said prime mover to operate an absorption refrigeration unit containing an aqueous solution comprising lithium halide as absorbent, and utilizing refrigeration developed by said absorption unit to chill said coolant which is passed in heat exchange relation with said cooled compressed refrigerant vapor to effect the aforesaid condensation thereof.

11. The improved refrigeration process of claim 10 wherein the condensed refrigerant is subcooled prior to isenthalpic expansion by countercurrent heat exchange with refrigerant vapor from the evaporation zone prior to the return of said refrigerant vapor to the compression thereof.

12. The improved refrigeraiton process of claim 10 wherein the pressure of the refrigerant during condensation and during evaporation is controlled to produce refrigeration at a temperature in the range of about 35° F. down to −50° F.

13. The improved refrigeration process of claim 11 wherein the fluid fuel is natural gas, and the pressure of the refrigerant during condensation and during evaporation is controlled to produce refrigeration at a temperature in the range of about 35° F. down to −50° F.

14. The improved refrigeration process of claim 10 wherein the lithium halide of the aqueous solution in the absorption refrigeration unit is lithium bromide.

15. The improved refrigeration process of claim 10 wherein the utilization of the waste heat in the hot combustion gases leaving the prime mover involves the passage of said gases through the absorption refrigeration unit.

16. The improved refrigeration process of claim 10 wherein the utilization of the waste heat in the hot combustion gases leaving the prime mover involves generating steam with said gases and passing said steam through the absorption refrigeration unit.

* * * * *